United States Patent [19]

Schroughan

[11] Patent Number: 4,844,652

[45] Date of Patent: Jul. 4, 1989

[54] SELF-ALIGNING CURBING MODULES

[76] Inventor: Benton Schroughan, 243 S. 25th St., Beech Grove, Ind. 46107

[21] Appl. No.: 202,373

[22] Filed: Jun. 6, 1988

[51] Int. Cl.[4] ..... E01C 11/22

[52] U.S. Cl. ..... 404/6; 404/7

[58] Field of Search ..... 404/6, 9, 7, 12, 13; 256/1, 13.1

[56] References Cited

U.S. PATENT DOCUMENTS

| | | | |
|---|---|---|---|
| 428,007 | 5/1890 | Landis | 404/7 |
| 477,721 | 6/1892 | Webb | 404/7 |
| 696,792 | 4/1902 | Bedell | 404/7 |
| 1,922,462 | 8/1933 | Tranchell | 404/13 |
| 3,174,412 | 3/1965 | Boyd et al. | 404/7 X |
| 3,326,099 | 6/1967 | Lova et al. | 404/7 |
| 3,373,668 | 3/1968 | Moore et al. | 404/7 X |
| 3,636,829 | 1/1972 | Palmer | 404/7 |
| 3,822,954 | 7/1974 | Asgariusson | 404/7 |
| 4,681,302 | 7/1987 | Thompson | 404/6 X |

FOREIGN PATENT DOCUMENTS

| | | | |
|---|---|---|---|
| 838122 | 2/1939 | France | 404/7 |
| 00559 | 8/1979 | Int'l Pat. Institute | 404/13 |

*Primary Examiner*—Jerome W. Massie, IV
*Assistant Examiner*—Gay Ann Spahn
*Attorney, Agent, or Firm*—Robert A. Spray

[57] ABSTRACT

A curbing module having interconnected sections as provided by body members interconnectable to provide a row of sections of curbing. The body members are preferably cast, and have embedded within each body member a generally U-shaped retainer member extending longitudinally and outwardly of each of the body members. Each end of the retainer member of one body member co-operates with a recess of the adjacent body member, providing, also with an associated stake-pin, the functions of both hold-down and alignment, providing and assuring a continuously attractive straightness and orderliness of the curbing as composed by a plurality of such sections.

8 Claims, 1 Drawing Sheet

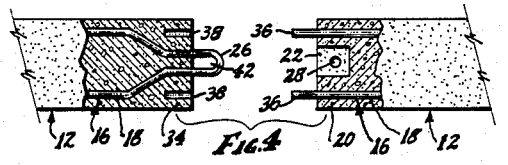
FIG. 4
FIG. 5
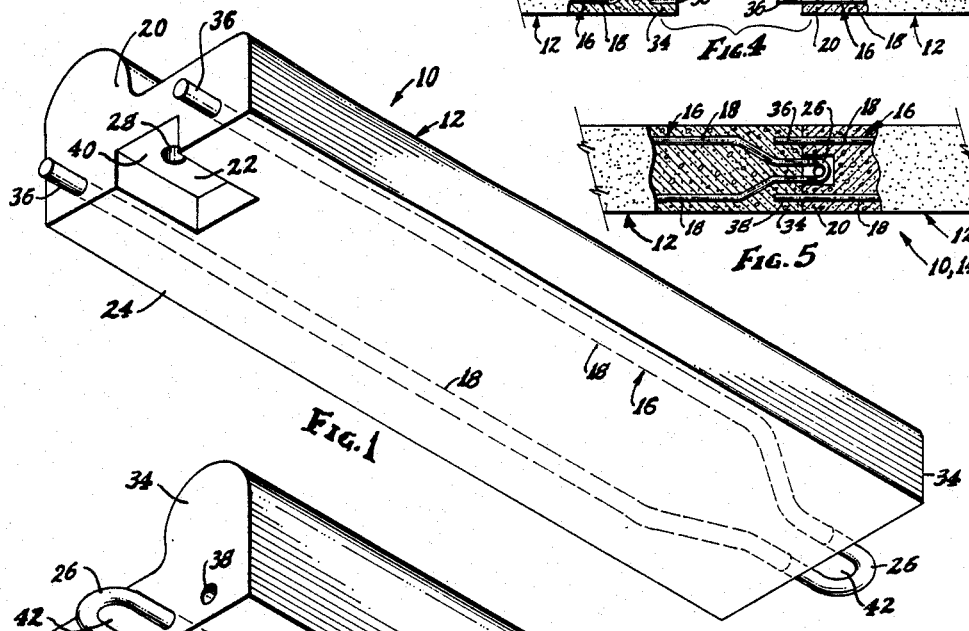
FIG. 1
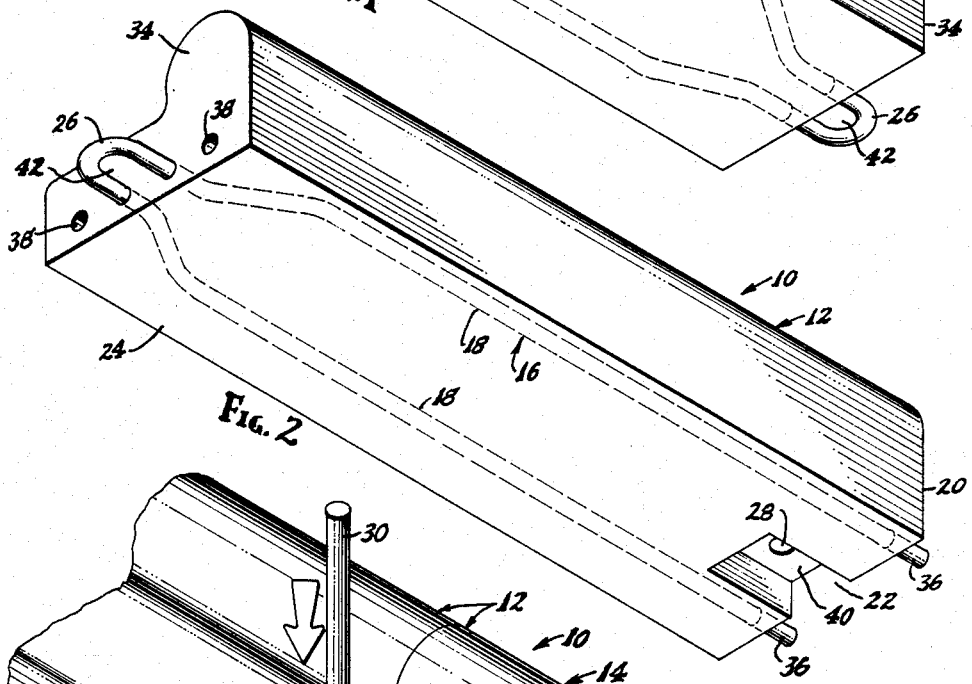
FIG. 2
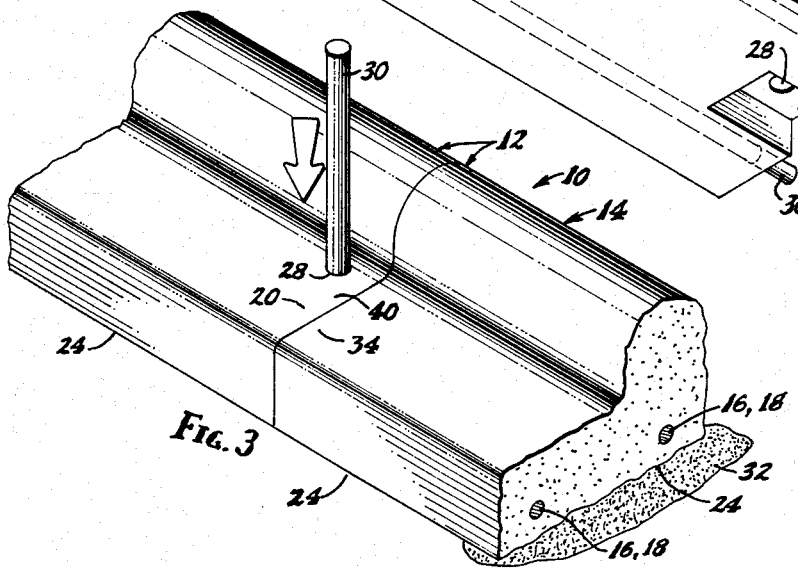
FIG. 3

SELF-ALIGNING CURBING MODULES

FIELD AND BACKGROUND OF THE INVENTION

The present invention relates to modular sections for such use as curbing, parking barriers, or roadway barriers; and more particularly the concepts provide and achieve ease of installation and correctness of alignment, practially assuring a good and workmanlike perfection of the installation even by unskilled laborers, of a row of curbing modules.

Curbings made of concrete have been in wide use for many scores of years; and since cementitious articles have long been made in pre-formed blocks or sections, and since attractiveness of a cement curbing installation is a primary goal, the correctness of an installation of curbing modules requires good alignment of the blocks, i.e., a good alignment of adjacent block-ends, considered both transversely or laterally of the axis of the curbing sections, and with respect to inclination, and elevation of the block-ends.

SUMMARIZATION OF THE PRESENT INVENTION

According to concepts of the present invention in a preferred form, good alignment is provided and practially assured by providing the concrete curbing in modular sections or body members, each of which is provided with a generally U-shaped retainer member extending longitudinally of the respective body member, and extending longitudinally with ends outward of both ends of the respective body member. Each of the body members is also provided with a corresponding recess means on both its ends, receivable respectively of the outwardly-extending ends of the retainer member.

The recess means which receives the end portion of the retainer member which provides the bight portion of the retainer member is also provided with a generally vertical recess intersecting the one which receives the bight, accommodating an associated stake pin to be driven through the two recesses, and into the ground.

Each joint is thus provided with laterally-spaced male/female fittings, the female set being such as to receive the ends of the retainer member remote from its bight; and by the various and inter-related alignment features, a proper and attractive alignment of all the curbing modules in the installation row is practically assured.

The invention's components and concepts are similar to those available in the prior art, except for the present concepts in particular:

In a hindsight consideration of the present invention to determine its inventive and novel nature, it is not only conceded but emphasized that the prior art had details usable in this invention if the prior art had had the guidance of the present concepts.

That is, it is emphasized that the prior art had several particulars:

a. The prior art had curbing of sectional or modular nature;

b. The prior art knew the advantages of interlocking of sectional modules, and of anchoring sectional modules to the ground;

c. The prior art had stiffener rods, and knew how to form rods into various shapes;

d. The prior art had embedded rods in concrete;

e. The prior art knew of various types of male/female joints;

f. The prior art knew of alignability achievable by means such as spaced male/female joints.

The prior art has attempted various types of curbing modules:

The prior art has tried different solutions to the problem of curbing or parking barrier sectional or modular alignment; and the existence of such modules, with features of being anchored to the ground and interconnected is not only conceded, it is emphasized, for as to the novelty here of the invention as considered as a whole, a contrast to the prior art helps show both the dissatisfaction of the various attempts of improvement, and the advantages and the inventive significance of the present concepts. Thus, as shown herein, the inventive significances of the present concepts is emphasized, and the nature of the concepts and their results can perhaps be easier understood.

Even further as indicating the inventive nature of the present concepts is the result of a Preliminary Patentability Search made in the Search files of the U.S. Patent Office, after this invention was made, and during the course of considering the desire and likelihood of patent protection.

The Search produced the following, all U.S. Patents:

0,428,007, Landis, 05/13/90
0,477,721, Webb, 06/28/92
2,065,861, Lines, 12/29/36
3,326,099, Cova et al., 06/20/67
3,373,668, Moore et al., 03/19/68
3,636,829, Palmer, 01/25/72

However, although connectability of sections or modules is shown, none show or suggest details of the overall combination of the present invention, as is the proper and accepted way of considering the inventiveness nature of the concepts.

That is, although the references found on the Search of prior art show an approach to the overall invention, significant features of the combination of the present invention are missing from the references, or are at least not shown in the overall combination of the present invention.

More particularly in this regard, the Search references fail to show the following, individually or at least in the overall combination, including a horizontal retainer member extending longitudinally of and outwardly of a body member module, the retainer member having different type connector means at each end, one end of the modules having both a male-like tongue but also a female-like recess, modules having both male-like and female-like connectors on both of its ends, or a female-like rcess or socket into which is fitted a male-like tongue and also is intersected by another recess for receiving an associated hold-down pin.

Accordingly, the various concepts and components are conceded and emphasized to have been widely known in the prior art in sectional pieces, even of modular curbing or barrier type; nevertheless, the prior art not having had the particular combination of concepts and details as here presented and shown as a novel combination different from the prior art and its suggestions, even only a fair amount of realistic humility, to avoid consideration of this invention improperly by hindsight, requires the concepts and achievement here to be realistically viewed as a novel combination, inventive in nature.

BRIEF DESCRIPTION OF THE DRAWINGS

The above description of the novel and advantageous curbing module, with ease of assembly and interlocking features, is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing of the inventive concepts for such a module whose concepts of the present invention are illustrated in this embodiment.

In the drawings:

FIGS. 1, 2 and 3 are isometric pictorial illustrations of curbing sections embodying the alignment means of the invention, and more particularly;

FIGS. 1 and 2 are curbing sections or body members, identical in form, although in these views showing them from opposite points of observation to better show each of the ends thereof; and FIG. 3 is a completed joint, showing adjacent ends of two adjacent curbing sections in fragmental detail but joined by the alignment means of the invention, including a view of an associated stake-pin being driven through overlapping portions of the sections, as indicated by the indicator arrow; and FIGS. 4 and 5, in smaller scale, are plan views, partly in horizontal cross-section, of adjacent ends of a pair of the curbing sections embodying the invention, FIG. 4 showing them about to be pushed to a joined condition, and FIG. 5 showing them joined, and ready for the stake-pin step indicated in FIG. 3.

DETAILED DESCRIPTION OF PREFERRED EMBODIMENT

As shown in the drawings, the concepts of the present invention provide a curbing module means 10 shown as having at least three identical body members 12 which co-operate to provide a section of a curbing installation 14, achieving and assuring a long-time alignment both laterally and vertically, a curbing installation 14 which will not be disturbed by traffic, weather, roadway or sidewalk installation, etc., all assuring the attractiveness achieved by orderliness and perfection, and achieving these goals without a requirement of high skill of the installer.

The body members 12 are shown as provided each with a force or retainer member 16 preferably of a generally U-shape, the legs 18 of which are in the same horizontal plane, and the retainer members 16 extend longitudinally of the respective body member 12. The retainer members 16 also extend longitudinally outward of both ends of the respective body member 12, and the retainer member ends are described below.

Co-operating with the ends of the retainer members 16, the body members 12 are also provided with recess means on both ends of the body members 12, described below as receivable respectively of the outwardly-extending ends of the said retainer member 16.

As a basic feature of the invention, at least one of the sets of retainer member 16's ends and its associated recess means of an adjacent body member 12, provide by their co-operating engagement an alignment means for alignment of adjacent body members; but, as mentioned above, each body member 12 has an end of its retainer member 16 extending also out the other end for a holding function explained below.

The hold-down details are shown in the illustrated embodiment as follows: The body member 12 is provided at a first end 20 with a recess means 22 open to the body member end 20 and open to the lower face 24 of the body member 12. This recess means 22 receives the end portion 26 of the retainer member 16 which provides the bight portion 26 of the adjacent body member's retainer member 16.

The body member 12's first end 20 is also provided with a second recess 28 which intersects the recess means 22 and which is of a generally vertical orientation to intersect the bight portion 26 of the retainer member 16 of the adjacent body member 12; and an associated stake pin 30 is provided to be driven through the second recess 28, into the first recess means 22 which receives the retainer means' bight portion 26, and through the bight portion 26 of the retainer member 16 of the adjacent body member 12 and driven into the associated ground 32 upon which the curbing module means 10 is to be placed.

This provides a sturdy hold-down function, holding the respective two adjacent body members 12 to the ground 32, and holding them flush or vertically even, and may provide some lateral alignment function.

More specifically as providing the lateral alignment function, however, are the alignment details now to be mentioned. That is, the end 34 of each body member 12 which is opposite the body member end 20, and is the respective body member end which in the module assembly 10 of the body members 12 is adjacent the end 36 of the retainer member 16 remote from its bight portion 26, is provided with a recess means 38 which is of a sufficiently close fit with the ends 36 of the adjacent body member's retainer member 16 that it provides the lateral alignment of adjacent body members 12.

The recess means 38 is two longitudinally-directed holes 38, one for each leg-end 36, and spaced vertically and laterally to register with the leg-ends 36 in proper alignment.

In the illustrated embodiment the leg-ends 36 of the retainer member 16 are provided to be at a large spacing, giving good alignment leverage, but the retainer member 16 is provided to have its bight portion 26 of smaller size, as considered transversely of the body member 12, than is the spacing of the leg-ends 36, providing a relatively close tightness of the hold-down details described above but a relatively large spacing at the leg-ends 36 mentioned above for good lateral alignment effectiveness.

It will also be noted, as another factor or description of the inventive concepts of the illustrated embodiment, tht the body members 12 are provided each with a retainer means 16 having at one body member end 20 a connector means 36 of a first type, and at the other body member end 34 a connector means 26 of a second type.

Considering also the connector means in terms of types, the body members 12 have a connector means 38 of a third type at the body member end 34 in which the retainer means 16 has a connector means 26 of the second type.

Further, as shown in the illustrated embodiment in terms of types of connectors, the first and third type connector means 36/38 of adjacent body members 12 are primarily co-operative to hold alignment of adjacent ones of body members 12; and the body member 12 has a connector means of a fourth type 22 at the body member end 20, i.e., the body member end 20 which is opposite to that at which the body member 12 has connector means 38 of the third type.

Still considering the connectors in terms of types, the second and fourth type connector means 26/22 are the ones co-operative to receive the associated stake pin 30 driven through the second and fourth type connector means 26/22 of adjacent body members 12 to hold adjacent body members 12 onto the ground 32.

Also, as shown the concepts provide that the legs 18 of the retainer member 16 are relatively widely spread at their end 36 in which they provide the first type connector means; but they are formed to be of lesser spacing in the region of the second connector means 26, i.e., lesser diameter than the bight portion 26, thus avoiding interference with the third type connector means 38.

Preferably, the retainers or force members 16 are embedded into the body members 12 by being placed thereinto as the body members 12 are cast.

In terms of male/female nature of the connector means, the connectors 36 and 26 may be considered male-like, but 26 is also female-like in its nature of receiving the hold-down stake pin 30. Connectors 22 and 38 are female-like; and the connector or recess 22 is also of a complex nature in that it is intersected by the vertical recess 28 of female nature which as mentioned receives the stake-pin 30.

The nature or factor of the multiple alignment means for adjacent curb-sections 12 is another way of considering the concepts by which the invention as a whole is achieved. That is, the curbing joint connection for adjacent sections 12 of curbing is seen to include the provision that the adjacent ends 20/34 of the two sections 12 are provided respectively with co-operating portions of first alignment means 36/38 and second alignment means 22/26.

Further with reference to the concept of alignment means, the first alignment means 36/38 provides alignment of the curbing sections 12 with respect to both laterally of the axis of the sections 12 and vertically with respect to one another, and the second alignment means 22/26 includes the provision that a portion 40 of one of the sections 12 overlies a portion 26 of the other of the sections 12, and the vertical hole 28 in the section-end 20 provides a vertical recess in the overlieing section-portion 40; and the underlying section-portion 26 of the other section-end 34, i.e., the bight 26, is provided with opening means 42 (as the open portion of the bight 26) which is in vertical registry, when the curbing sections 12 are lieing end to end with said ends 20 and 34 operatively adjacent, with the vertical recess or hole 28.

Thus, the second alignment means provides that the ends 20/34 of the adjacent sections 12 are fixable, at a definite elevation with respect to the associated ground 32 upon which they are lying, by the associated stake-pin 30 driven through the hole or vertical recess 28 of the overlying portion 40 and through the opening means 42 of the underlying portion or bight 26, of the adjacent ends 20/34 of adjacent curbing sections 12.

Also, considering the invention as a whole with respect to its alignment means, it is to be noted that the retainer member 16 (including its portions 18, 26, and 36) provides a force member extending longitudinally through each respective curbing section 12, and outwardly of the ends thereof, and providing at one section-end (20) a part 36 of the first alignment means 36/38 of one joint and at its other end (at section-end 34) the opening means 42 of the underlying portion 26 of the second alignment means 22/26 of an adjacent joint.

CONCLUSION

It is thus seen tha curbing modules, constructed and used according to the inventive concepts herein set forth, provide novel concepts of a desirable and advantageous device, yielding the advantages of a curbing section which provides good alignment and ease of proper installation, conceptually different from the prior art even though interconnectability as a basic concept has of course been known for years; yet significantly this particular combination of prior art has not been suggested by the prior art, this achievement being a substantial and advantageous departure from prior art, even though the prior art shows attempts at improvement for many years. And particularly is the overall difference from the prior art significant when the non-obviousness is viewed by a consideration of the subject matter as a whole, as integrally incorporating the features different from the prior art, in contrast to merely those details of novelty themselves, and further in view of the prior art teaching away from the particular and inter-related concepts and features of the present invention.

In summary as to the nature of these advantageous concepts, their inventiveness is shown by novel features of concept and construction shown here, in novel and advantageous combination, not only being different from all the prior art known, but because the achievement is not what is or has been suggested to those of ordinary skill in the art, especially realistically considering this as comprising components which individually are similar in nature to what is well known to most persons, surely including most of the many makers and users of most sectional curbing pieces for many years, the entire world over. No prior art has suggested the modifications of any prior art to achieve the novel concepts here achieved, with the various features providing ease and practically automatic and full alignment of the sectional modules.

Accordingly, it will thus be seen from the foregoing description of the invention according to this illustrative embodiment, considered with the accompanying drawings, that the present invention provides new and useful concepts of a novel and advantageous curbing module having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

I claim:

1. A curbing module means comprising:

at least three body members each providing a section of curbing, and all three being substantially identical in respects herein mentioned, the body members being provided each with a generally U-shaped retainer member having a bight portion extending outwardly from a first end of the respective body member and extending longitudinally of the respective body member, and having legs with transversely-spaced ends which extend outwardly of a second end of the respective body member, each of the body members also provided with transversely-spaced recess means on an end thereof, receivable respectively of the outwardly-extending leg-ends of the said retainer member, at least one of the sets of retainer member leg-ends and its associated recess means of an adjacent body member providing by their co-operating engagement an alignment means for alignment of adjacent body members.

2. The invention as set forth in claim 1, in a combination in which the portion of each body member, which is provided with the recess means which receives the bight portion of the retainer member, is also provided with a second recess intersecting the first-named recess means and of a generally vertical orientation to intersect the said bight portion, an associated stake pin being provided to be driven through the said second recess, into the said first-named recess means which receives said bight portion and through the bight portion of the retainer member of the adjacent body member, and into the associated ground upon which the curbing module means is to be placed.

3. The invention as set forth in claim 1, in a combination in which the end of each body member which in the assembly of the three body members is adjacent the end of the retainer member remote from the bight portion thereof, is provided with its recess means to be a sufficiently close fit with the said end of the retainer member that it provides the said alignment.

4. The invention as set forth in claim 2, in a combination in which the end of each body member which in the assembly of the three body members is adjacent the end of the retainer member remote from the bight portion thereof, is provided with its recess means to be a sufficiently close fit with the said end of the retainer member that it provides the said alignment.

5. The invention as set forth in claim 1, in a combination in which the leg-ends of the retainer member are provided to be at a large spacing, but the retainer member is provided to have its bight portion of smaller size, as considered transversely of the body member, than is the spacing of the leg-ends.

6. The invention as set forth in claim 2, in a combination in which the leg-ends of the retainer member are provided to be at a large spacing, but the retainer member is provided to have its bight portion of smaller size, as considered transversely of the body member, than is the spacing of the leg-ends.

7. The invention as set forth in claim 3, in a combination in which the leg-ends of the retainer member are provided to be at a large spacing, but the retainer member is provided to have its bight portion of smaller size, as considered transversely of the body member, than is the spacing of the leg-ends.

8. The invention as set forth in claim 4, in a combination in which the leg-ends of the retainer member are provided to be at a large spacing, but the retainer member is provided to have its bight portion o smaller size, as considered transversely of the body member, than is the spacing of the leg-ends.

* * * * *

UNITED STATES PATENT AND TRADEMARK OFFICE

CERTIFICATE OF CORRECTION

PATENT NO. : 4,844,652

DATED : July 4, 1989

INVENTOR(S) : Benton Schrougham

It is certified that error appears in the above-identified patent and that said Letters Patent is hereby corrected as shown below:

On the title page, under item [19] and in item [76], "Schroughan" should be --Schrougham--.

Col. 5, line 51, correct the spelling of "lieing" to be --lying--.

Col. 6, line 5, correct the spelling of "tha" to be --that--.

Signed and Sealed this

Twenty-fourth Day of July, 1990

*Attest:*

HARRY F. MANBECK, JR.

*Attesting Officer*

*Commissioner of Patents and Trademarks*